169-43 SR
5/25/76 OR 3,958,643

United States Patent [19]

Landsberg

[11] 3,958,643

[45] May 25, 1976

[54] SPRINKLER SYSTEM AND METHOD OF OPERATING THE SAME

[75] Inventor: Ernst Landsberg, Bergisch-Gladbach, Germany

[73] Assignee: Walther & Cie Aktiengesellschaft, Cologne-Dellbrueck, Germany

[22] Filed: Dec. 11, 1974

[21] Appl. No.: 531,618

Related U.S. Application Data

[62] Division of Ser. No. 414,539, Nov. 9, 1973, Pat. No. 3,888,314.

[30] Foreign Application Priority Data

Nov. 11, 1972 Germany ..... 2255369

[52] U.S. Cl. ..... 169/43; 169/20; 169/23

[51] Int. Cl.[2] ..... A62C 37/06

[58] Field of Search ..... 169/19, 20, 21, 22, 169/23, 43, 46

[56] References Cited

UNITED STATES PATENTS

| | | | |
|---|---|---|---|
| 2,342,589 | 2/1944 | Lewis | 169/19 |
| 2,586,720 | 2/1952 | Rowley | 169/19 |
| 2,713,916 | 7/1955 | Muckenfuss | 169/19 |

*Primary Examiner*—Evon C. Blunk
*Assistant Examiner*—Michael Mar
*Attorney, Agent, or Firm*—Michael J. Striker

[57] ABSTRACT

A sprinkler system having a pressurized sprinkler conduit which is separated from a water supply by a normally closed valve, and a fire alarm system having a circuit which is connected with this valve and opens the same in response to the detection of a fire by the circuit, is operated by detecting the absence of electrical energization of the fire alarm circuit, and thereupon operating the sprinkler system as a function of pressure losses in the sprinkler conduit rather than as a result of the operation of the fire alarm system.

6 Claims, 3 Drawing Figures

SPRINKLER SYSTEM AND METHOD OF OPERATING THE SAME

This is a division, of application Ser. No. 414,539, filed Nov. 9, 1973 now Pat. No. 3,888,314.

BACKGROUND OF THE INVENTION

The present invention relates generally to a sprinkler system, and more particularly to a sprinkler system construction and to a method of operating the same.

Various types of sprinkler systems are already well known in the art. One type which is of particular interest in the context of the present invention involves a sprinkler conduit (which may be composed of a plurality of conduit sections) which is filled with gas under pressure and separated from a water supply conduit by a valve which is normally closed. Such systems are well known and may include a so-called "pre-action" system. In the type of sprinkler system which uses only a pressurized sprinkler conduit, the valve connecting the sprinkler conduit with the water supply conduit opens when it senses a pressure drop in the sprinkler conduit, for instance because pressurized gas can escape from the same due to the fact that one or more of the sprinklers of the sprinkler conduit have opened, if, however, the system is of the type using a "pre-action" system, then the valve connecting the sprinkler conduit with the water supply conduit is not opened when a pressure drop occurs in the sprinkler conduit itself, but instead is opened only in response to the operation of a separate fire alarm system. In this case, the opening of one or more sprinklers of the sprinkler conduit will result only in the giving of a signal indicative of the fact that the pressure in the sprinkler conduit has dropped. The operation of the fire alarm system also produces a signal, and at the same time opens the valve which separates the sprinkler conduit from the water supply conduit. However, only if two conditions are met can the sprinkler system operate in these circumstances, namely one or more sprinklers must be open and the fire alarm system must detect a fire and open the valve separating the sprinkler conduit from the water supply conduit.

This type of combined system is used only for certain purposes, for the simple reason that the additional pre-action system with its fire alarm imposes a check upon the operation of the sprinkler system which does not exist in prior-art sprinkler systems that do not have a pre-action system. Of course, this combined type of system has its advantages, namely if it is for instance installed in structures housing computer installations or the like, where it is absolutely essential that water damage be incurred only if a fire is actually present, not if for some reason one of the sprinklers of the system should malfunction and open without the presence of a fire. The disadvantage of this type of system is, of course, the fact that if the fire alarm system should not properly operate, either as an actual malfunction or because the electrical energy required for its operation should not be available, the sprinkler system cannot operate at all, even if one or more of the sprinklers themselves should open. This means, in other words, that a fire might conceivably occur which would not be put out by operation of the sprinkler system, because the latter would be prevented from operating (even though its sprinklers should open) by the fact that the valve separating it from the water supply conduit is maintained closed due to the failure of the pre-action system to operate.

SUMMARY OF THE INVENTION

It is, accordingly, a general object of the present invention to overcome the disadvantages of the prior art.

More particularly, it is an object of the present invention to provide an improved sprinkler system of the type discussed above, provided with a pre-action system, which avoids the aforementioned disadvantages.

Another object of the invention is to provide such a sprinkler system which is highly reliable in its operation.

An additional object of the invention it to provide a sprinkler system of the type outlined above which is relatively simple in its construction.

In keeping with the above objects, and with others which will become apparent hereafter, one feature of the invention resides, in a sprinkler system, in a combination which comprises a sprinkler conduit and a water supply conduit. A diaphragm valve is interposed between the sprinkler conduit and the water supply conduit, and a pressure conduit communicates with a source of pressurized gas and with the diaphragm valve for the purpose of normally maintaining the latter closed by the pressure of the gas. A bypass conduit has one end portion communicating with the pressure conduit intermediate the source and the diaphragm valve, and another end portion which communicates with the sprinkler conduit. A magnetic valve is interposed in the bypass conduit, and a venting valve is interposed in the pressure conduit. A permanently energized electrical fire alarm circuit is connected with the magnetic valve and the venting valve and normally maintains both of them closed. This circuit is operative for opening the venting valve when detecting a fire, and for opening the magnetic valve in automatic response to the circuit becoming deenergized.

The electrical fire alarm circuit may be part of a fire alarm system that is of electrical, pneumatic or mechanical type.

By using the present invention, the sprinkler system is converted from an operation in which it depends upon the signals derived from the pre-action system, into a conventional sprinkler system in which it does not require such dependence for its operation and is completely reliable independently of whether or not the pre-action system may be malfunctioning or may not function at all due to a lack of electrical energy.

If, for instance, the supply of electrical energy is interrupted, or if the system is otherwise malfunctioning, this would inherently prevent the valve which separates the sprinkler conduit from the water supply conduit from opening even though a fire may have been detected by one or more of the sprinklers of the sprinkler conduit. The present invention, however, assures that as a result of the interruption of the electrical energy supply the magnetic valve which is interposed in the bypass conduit will automatically open, and provide for a connection between the sprinkler conduit and the pressure conduit, so that if a sprinkler of the sprinkler conduit opens under these circumstances, the pressure drop which occurs in the sprinkler conduit can be communicated via the now open magnetic valve to the diaphragm valve which will open as soon as the pressure drop has reached the operating level of the diaphragm valve, so that water can now enter the sprinkler conduit and issue from the same via the open sprinkler or sprinklers.

Of course, as pointed out above, the alarm system can be operated not only electrically, but also pneumatically or mechanically, in which case the magnetic valve would be replaced with a different type of control valve, that is a control valve which is either a pneumatically operated valve or a mechanically operated valve.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
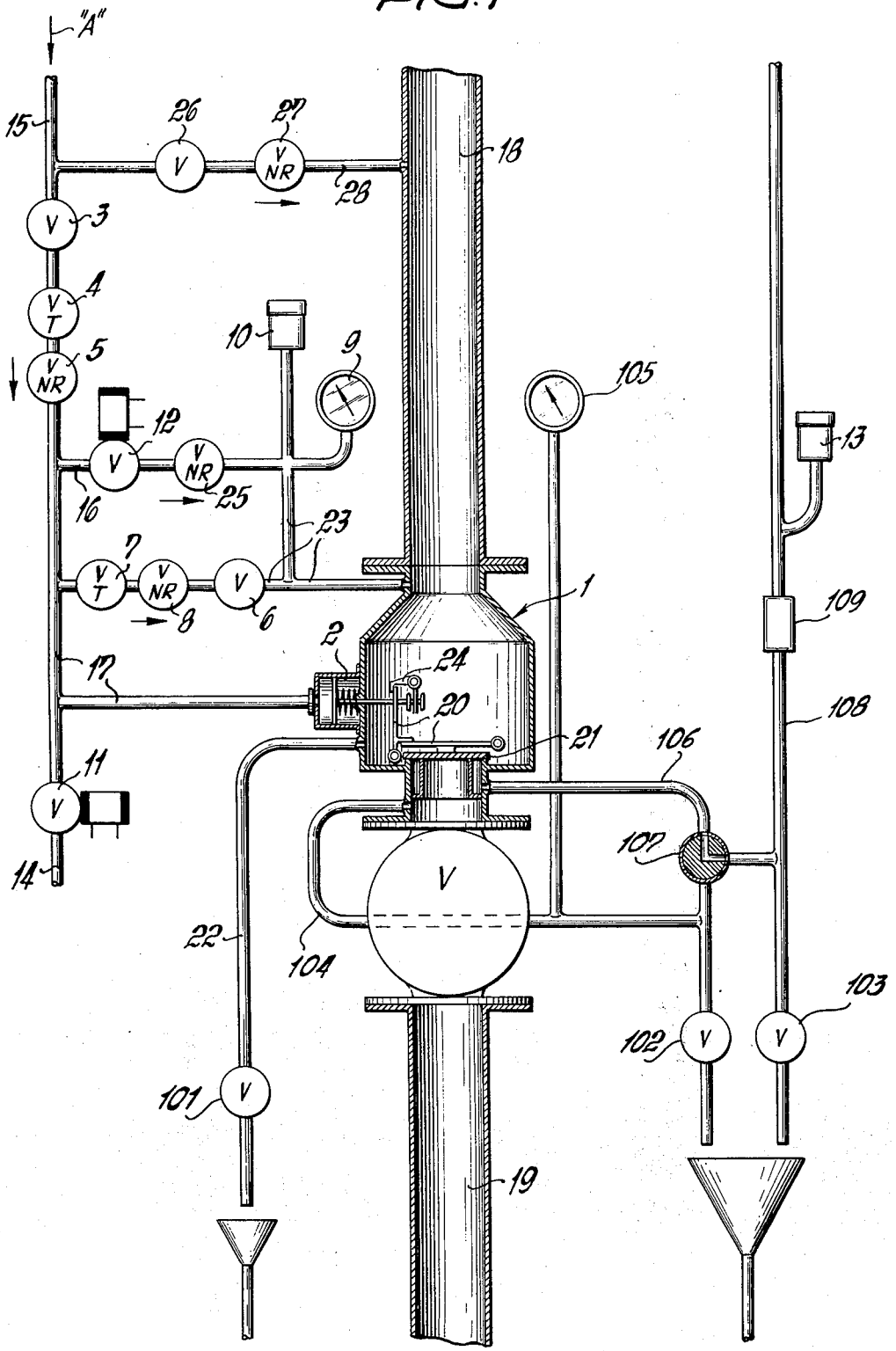
FIG. 1 is a diagrammatic illustration of a sprinkler system according to the present invention, with the separate fire alarm system having been omitted.

Referring firstly to FIG. 1, it will be seen that in this embodiment the so-called pre-action system is illustrated, which utilizes a system of sprinkler conduits 18 (only one fragmentarily shown) provided with normally closed non-illustrated sprinklers of any type known per se. These sprinklers are provided with heat sensors which will open when they sense an increase in the ambient temperature above a preselected level. The system has a pre-action valve 1 which is interposed between the conduit system 18 and a water supply conduit 19. This valve 1 is of course normally closed, and is opened not by a pressure drop in the system 18 resulting from opening of one or more of the non-illustrated sprinklers, but by a separate fire alarm system.

The valve 1 is provided with a separate chamber 2 which is subdivided into two compartments by the diagrammatically illustrated diaphragm which, in turn, is connected via a linkage 20 with a valve member 21 that is maintained in closed position under normal operating circumstances. Removal of water takes place via a conduit or conduit system 22.

A conduit 17 is connected with the chamber 2 at the pressure side of the diaphragm therein and, in turn, communicates with a further conduit 15 which communicates with a non-illustrated source of pressurized gas, for instance air, which is diagrammatically identified with character A. A conduit 28 communicates with the conduit 15 and with the conduit system 18, and a further conduit 23 also communicates with the conduit 15 and with the conduit system 18. The direction of air flow from the source is identified by the arrow adjacent the character A.

A manually operable valve 3 is interposed in the conduit 15, as are a throttle valve 4 and a one-way valve 5. These may be combined into a single unit in known manner, if desired. In any case, the valves 3, 4 and 5 are located upstream of the conduit 17, insofar as the direction of flow of the incoming compressed air or gas is concerned. A further shutoff valve 6, throttle valve 7 and one-way valve 8 are interposed in the conduit 23. In addition, a conduit 14 branches off conduit 17 and has interposed in it a magnet valve 11 which is electrically connected with the fire alarm system shown in FIG. 2.

A conduit 16 communicates at its one end via the conduit 23 with the conduit system 18, and at its other end with the conduit 17, intermediate the conduit 15 and the chamber 2. A normally closed magnet valve 15 and a one-way valve 25 are interposed in the conduit 16. The magnet valve 12 is also connected with the fire alarm system shown in FIG. 2.

The conduit 23 which communicates with the conduit system 18, is also connected with a pressure measuring gauge 9 and a pressure switch 10. A further pressure switch 13 is provided which is connected with the valve 1 to provide a signal when the latter opens.

In operation of the system thus far described, it will be appreciated that in standby condition the pre-action valve 1 is closed. It is maintained closed by the pressure of compressed gas which is derived from the source A via the conduits 15 and 17 and exerts enough pressure in the chamber 2 upon the diaphragm therein to maintain the valve member 21 in closed position. This compressed gas is contantly supplied via the valves 3, 4 and 5 at the level necessary to maintain the valve member 21 in closed position, and at the same time additional compressed gas is supplied via the valves 6, 7 and 8 into the conduit system 18 so that the latter is pressurized, given the fact that its sprinklers are normally closed unless they detect an increase in ambient temperature. The pressure at which the conduit system 18 is to be maintained, can be determined from the gauge 9 and if a dangerous drop in the pressure in the conduit system 18 should take place, the pressure switch 10—which has been set to provide a signal before the level of pressure in the conduit system 18 can drop to the level where the sprinkler system can operate—will provide such a signal to alert a user. In this operating condition the valves 11 and 12 are closed, as are the valves 26 and 27.

Figure 2:
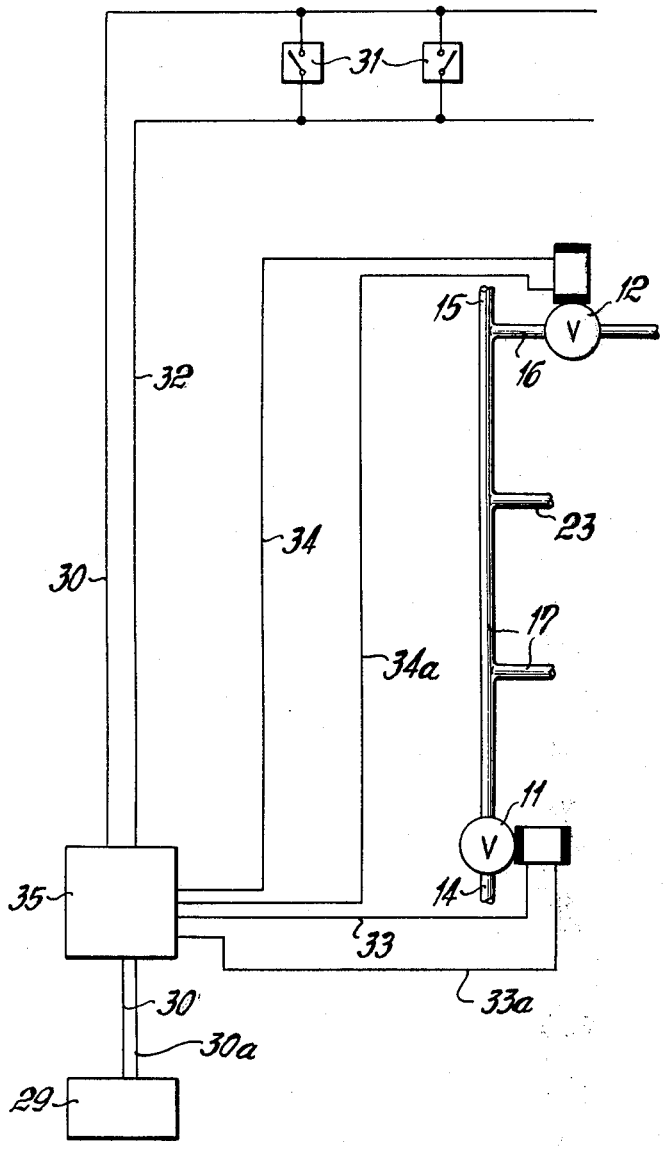
FIG. 2 shows in a diagrammatic presentation the fire alarm system which is used in conjunction with the embodiment of FIG. 1

If, now, the separately installed fire alarm system of FIG. 2 should operate, indicating that it has a detected a fire, it will provide an impulse to the valve 11, causing the same to open. This vents the conduits 15, 17 via the valve 8, causing a pressure drop in these conduits. When a certain pressure drop has occurred, for instance by one atmosphere, the diaphragm in the chamber 2 is no longer sufficiently deflected, and the spring which biases it in opposition to the pressure exerted upon it by the pressurized gas, will now deflect the diaphragm (to the left in FIG. 1) and cause the valve member 21 of the valve 1 to open. This permits water to flow from the conduit 19 into the sprinkler conduit system 18. Assuming that the fire detected by the fire alarm system of FIG. 2 was sufficiently significantly so that one or more of the sprinklers of the conduit system 18 have also opened, water will now issue from these sprinklers to put out the fire.

When the valve 1 opens, a normal alarm will be given as in the case of other systems of this type, by means of one or more non-illustrated components such as bells or the like. At the same time, the pressure switch 13 can supply a signal to an indicating board at a fire station or the like.

Should only one sprinkler in the system 18 open, then a pressure drop will occur in the system 18 since the amount of gas that can escape through the sprinkler which has opened is substantially greater than the amount of gas that can re-enter via the throttle valve 7. This pressure drop will be observable, because it will cause the pressure switch 10 to originate a signal indicative of the existence of a pressure drop.

If, as is of course inevitable, the alarm system of FIG. 2 should malfunction or its energy supply (assuming it is electrically energized) should be interrupted, then the valve 1 would not properly operate even though a fire might be present because it is maintained close by the gas pressure. However, in the case of a malfunction or in the event the electrical energy supply should be interrupted, the normally energized and normally closed magnet valves 11 and 12 will become deenergized and as a result will immediately open. This produces a communication between the sprinkler conduit system 18 on the one hand, and the control conduit system composed of the conduits 14, 15 and 17 on the other hand. This, in turn, means that the system now operates as a normal sprinkler system known from the art, in that if a sprinkler in the conduit system 18 should now open, a pressure drop will take place in the conduit system 18. Unlike the previously described result of such a pressure drop, however, in this instance the pressure drop will be communicated to the chamber 2 resulting in a drop of pressure in the chamber 2 also, and permitting an automatic opening of the valve member 21 of the valve 1 as soon as the pressure acting upon the diaphragm in the chamber 2 has dropped sufficiently.

FIG. 2 shows the fire alarm system which is used in conjunction with the embodiment of FIG. 1 and which here is of an electrical type. Reference numeral 29 identifies a source of electrical energy, and reference numeral 30 identifies a conductor which connects the source 30 with a detector arrangement 31. The conductor 34 is also electrically energized and will be seen to be connected with the valve 12, to maintain the same in closed position.

In the event a fire is detected, the arrangement 31 produces an electrical communication between the conductors 30 and 32, which results in the development of an electrical signal at the control box 35 which, in turn, supplies electrical energy via the conductor 33 to the magnetic valve 11, causing the same to open so that the conduits 15, 17 can vent and the pressure in them drop. At the same time, the control box 35 cuts off electrical energy to the conductor 34, and this causes the valve 12 to open also.

The above operation is the one which takes place if the system in FIG. 2 operates in its intended manner. If, however, the system should malfunction or the supply of electrical energy from the source 29 should be interrupted for any reason, then the conductor 34 will no longer carry electrical energy and this will cause the valve 12 to immediately open and to switch over the system to pressure-controlled operation as described earlier.

It will be understood that each of the elements described above, or two or more together, may also find a useful application in other types of constructions differing from the type described above.

Figure 3:
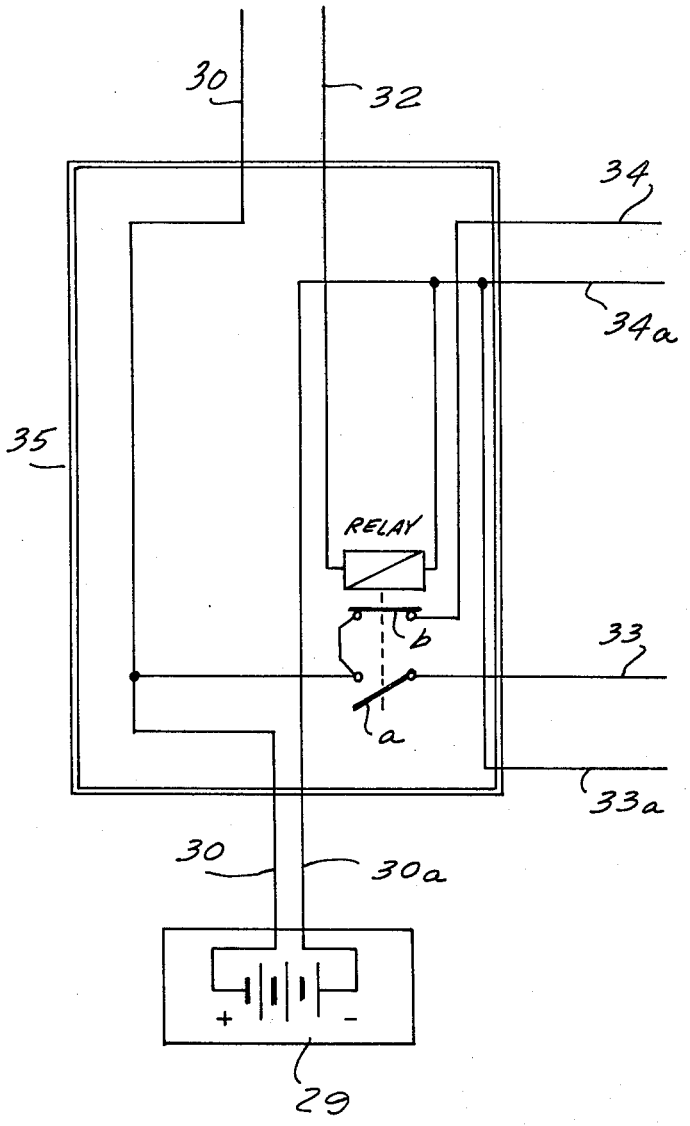
FIG. 3 is a diagram, showing details of a component of FIG. 2.

The elements designated with numerals 101-109 in FIG. 1 are well known per se in this field of art: they have therefore been shown only diagrammatically. Elements 101, 102 and 103 are valves which are manually operated and serve to drain water from the system. Element 104 is a water pipe with an associated pressure indicator 105 to permit monitoring of the water supply pressure in the system. Elements 106 and 108 are alarm conduits and element 107 a test valve for testing of the alarm conduits. Normally, the valve 107 will be in the illustrated position. In the event of fire, valve member 21 moves to open position and water flows into conduit system 18. At the same time, water can now also flow into conduit 106 and from the same via valve 107 into conduit 108. The latter may have a bell or other signalling device interposed in it, which is activated by the entry of the water and provides an alarm signal. Element 109, finally, is a filter which prevents the entry of contaminants into the (not illustrated) signalling device, since this could render the device inoperative. Details of the element 35 of FIG. 2 are shown by way of example in FIG. 3. Such elements are well known per se, being for instance manufactured by the General Electric Co. The elements 31 are contact-type sensors which complete an electric circuit when they sense fire, smoke, etc. When this takes place, current can flow from source 29 via line 32 and open valve 11. Element 35 uses a relay (see FIG. 3) which operates when current flows in this manner, closing the switch a and raising the switch b (see FIG. 3). This causes current to flow in line 33 and to be interrupted in line 34. The latter result causes the magnetic valve 12 to open. If current supply is interrupted, current ceases to flow in line 30 and line 34, so that in this case also the valve 12 will open.

While the invention has been illustrated and described as embodied in a sprinkler system, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims

1. A method of operating a sprinkler system having a pressurized sprinkler conduit which is separated from a water supply by a normally closed valve, and a fire alarm system which is connected with said valve and opens the same in response to detection of a fire by the alarm system, comprising the steps of normally maintaining said valve closed unless a pressure loss in said sprinkler conduit and a detection of fire by said fire alarm system coincide; detecting when said alarm system is inoperative; and opening said valve in response to such detection so that the sprinkler system thereafter can operate in response to the occurrence of a pressure loss in said sprinkler conduit.

2. A method as defined in claim 1; and further comprising the step of normally maintaining said valve closed by subjecting it to a biasing force.

3. A method as defined in claim 2, wherein said valve is in communication with a control conduit which contains a pressurized gas and which is in communication with said sprinkler conduit; and wherein the step of detecting comprises interposing a magnetic valve in said control circuit between the same and said sprinkler conduit, said magnetic valve being closed when said fire alarm is operative and opening in automatic response to said fire alarm circuit becoming inoperative.

4. A method as defined in claim 3; and further comprising the step of supplying additional pressurized gas into said sprinkler conduit and said control conduit, respectively, to compensate for leakage losses.

5. A method as defined in claim 3; and further comprising the step of signalling a pressure drop in said sprinkler conduit and said control conduit, respectively.

6. A method as defined in claim 1; and further comprising the step of electrically controlling said fire alarm system.

* * * * *